US006745787B1

(12) United States Patent
Curtis

(10) Patent No.: US 6,745,787 B1
(45) Date of Patent: Jun. 8, 2004

(54) WIND UMBRELLA

(76) Inventor: Wesley K. Curtis, 5 Rocky Ridge Rd., Irvine, CA (US) 92620

( * ) Notice: Subject to any disclaimer, the term of this patent is extended or adjusted under 35 U.S.C. 154(b) by 0 days.

(21) Appl. No.: 10/165,145

(22) Filed: Jun. 7, 2002

(51) Int. Cl.[7] ..... E04H 15/28

(52) U.S. Cl. ..... 135/98; 135/20.1; 135/117; 135/155

(58) Field of Search ..... 135/20.1, 16, 98, 135/99, 155, 117, 118; 248/530, 156; 43/1–2

(56) References Cited

U.S. PATENT DOCUMENTS

| | | | | | |
|---|---|---|---|---|---|
| 820,261 | A | * | 5/1906 | Russell | 52/74 |
| 1,946,137 | A | | 2/1934 | Frost | 155/1 |
| D93,183 | S | | 8/1934 | Roth | |
| 2,441,109 | A | * | 5/1948 | Carlson | 135/98 |
| 3,184,235 | A | * | 5/1965 | Hibrich | 473/421 |
| 4,098,281 | A | * | 7/1978 | Bonfilio | 135/130 |
| 4,506,688 | A | | 3/1985 | Bethoon et al. | 135/107 |
| 4,646,770 | A | | 3/1987 | Lobato | 135/102 |
| 4,649,678 | A | | 3/1987 | Lamson | 52/103 |
| 4,658,843 | A | | 4/1987 | Raymond | 135/19.5 |
| 4,739,784 | A | | 4/1988 | Fast | 135/117 |
| 4,836,231 | A | * | 6/1989 | Peterson | 135/98 |
| 4,836,232 | A | * | 6/1989 | De Rosa et al. | 135/99 |
| D321,924 | S | | 11/1991 | Bonner | D21/253 |
| 5,214,872 | A | * | 6/1993 | Buyalos, Jr. | 136/98 |
| 5,379,786 | A | | 1/1995 | Lynam | 135/87 |
| D363,597 | S | | 10/1995 | Byrne | D3/5 |
| 5,642,747 | A | * | 7/1997 | Rizzotti | 135/16 |
| 5,692,720 | A | * | 12/1997 | Griggs | 248/530 |
| D443,409 | S | | 6/2001 | Pilz et al. | D3/5 |
| 6,296,005 | B1 | * | 10/2001 | Williams et al. | 135/98 |
| D456,131 | S | * | 4/2002 | Dotson, Jr. | D3/10 |
| 6,422,252 | B1 | * | 7/2002 | Pilz et al. | 135/98 |

FOREIGN PATENT DOCUMENTS

| | | |
|---|---|---|
| EP | 956790 | * 11/1999 |

* cited by examiner

*Primary Examiner*—Winnie S. Yip
(74) *Attorney, Agent, or Firm*—Suiter West PC LLO

(57) ABSTRACT

Accordingly, the present invention is directed to a wind umbrella, for providing a wind barrier with the functionality and convenience of an umbrella. The wind umbrella includes a central post, a spine assembly comprising a plurality of ribs and support rods, and a covering. Further, the wind umbrella includes a surface spike, multiple connectors, multiple hinges and multiple joints, which enable it as a collapsible device and securely anchor the wind umbrella in a surface. In operation, the present invention provides a user a lightweight, half umbrella like, portable device which when opened lays horizontally on the surface extending a barrier, generally quarter sphere in shape, perpendicularly from the ground up.

20 Claims, 6 Drawing Sheets

WIND UMBRELLA

FIELD OF THE INVENTION

The present invention generally relates to the field of providing protection to persons and, more particularly, protection from wind for persons in stationary locations outdoors, or other occurrences, such as blown sand, the sun, small objects and other such examples as may be encountered.

BACKGROUND OF THE INVENTION

Recreational outdoor people are often looking for a way to enhance their experience. From recreational games to protective eyewear to barriers against the wind and other unwanted elements and interruptions. Popular on the beaches of today are large umbrella structures and fan-like structures mounted on poles to provide protection against the sun and wind. However, when set up, such devices are commonly capable of providing minimal wind protection. Consequently, beachgoers may be forced to carry a variety of instruments to produce a make-shift barrier to protect themselves.

Typically, beachgoers are loading items into their vehicle, transporting those items some distance to a final location and setting up those items on the sandy surface. Consequently, convenience, portability and functionality are key ingredients to any item designed for use on the beach. The ability to provide a complete wind barrier with the ease of use of a standard umbrella may provide a distinct advantage over other devices.

Therefore, it would be desirable to provide a wind umbrella capable of collapsing and opening like an umbrella for easy loading and transporting as well as easy set up, wherein the wind umbrella is situated horizontally on the surface, such as a sandy beach, and extends a barrier, generally quarter sphere in shape, perpendicularly from the ground up

SUMMARY OF THE INVENTION

Accordingly, the present invention is directed to a wind umbrella, for providing a wind barrier with the functionality and convenience of an umbrella. The wind umbrella includes a central post, a spine assembly comprising ribs and support rods and a covering. Further, the wind umbrella includes a surface spike, connectors, hinges and joints, which enable it as a collapsible device and securely anchor the wind umbrella in the ground. In operation, the present invention provides a user a lightweight portable device which when opened lays horizontally on the surface extending a barrier, generally quarter sphere in shape, perpendicularly from the ground up.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1A:
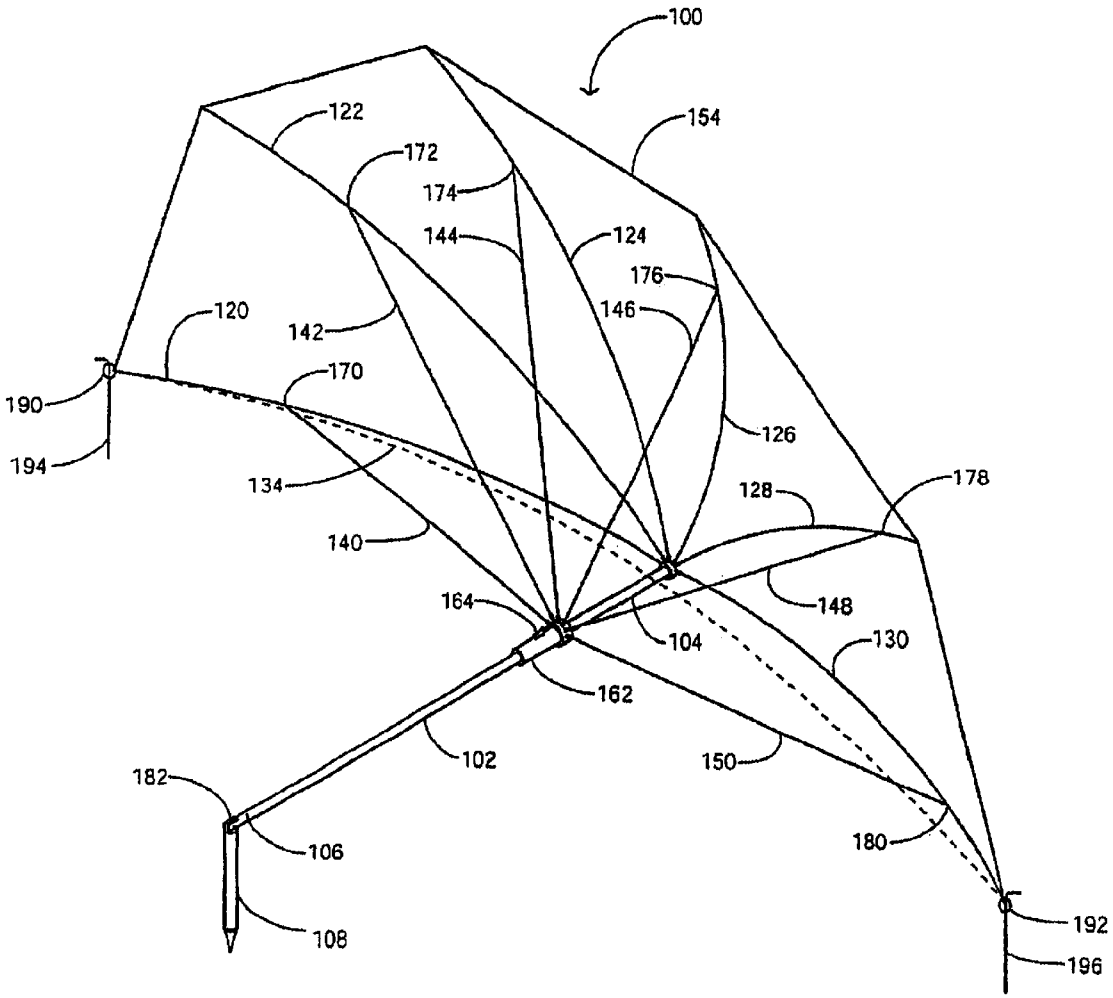
FIG. 1A is an isometric view illustrating a wind umbrella in an open position in accordance with an exemplary embodiment of the present invention.

Referring, generally, to FIGS. 1 through 4 illustrations of exemplary embodiments of a wind umbrella 100 are shown. Wind umbrella 100 includes a central post 102, a surface spike 108 and a spine assembly comprised of six ribs 120, 122, 124, 126, 128 and 130 with a first edge 134 and six support rods 140, 142, 144, 146, 148 and 150. The spine assembly may be comprised of any number of ribs and support rods without departing from the spirit and scope of the present invention. Additionally, a covering 154, connector 160, traveling connector 162, hinged joints 170, 172, 174, 176, 178 and 180 and pivoting joint 182 are included. It is contemplated that the number of joints and connectors may vary to accommodate other embodiments. Anchoring loops 190 and 192 are connected to rib 120 and rib 130 respectively, and are capable of engaging securing means such as metal stakes 194 and 196 to provide further stability to wind umbrella 100. The combination of rib 120 and rib 130 comprise a first edge 134.

In the current embodiment central post 102 is a solid metal shaft with a first end 104 and a second end 106, which provides the support framework upon which the spine assembly is mounted. In other embodiments central post 102 may be a hollow tube to decrease weight. A locking mechanism 103, shown in FIG. 1B, engages traveling connector 162, securing wind umbrella 100 in the open position. Locking mechanism 103 is included between first end 104 and second end 106 on central post 102. Central post 102 may be composed of steel, aluminum or any other suitable metals. Further, central post 102 may be composed of very rigid plastic, composite, wood, fiberglass and the like. In the present embodiment central post 102 is of a single predetermined length, however, it is contemplated that it may be telescopic, that is selectively extendable, to allow the user to determine the best length for use.

Central post 102 is an anchoring and support device. In operation central post 102 is placed horizontally upon the surface where wind umbrella 100 is to be located. This will allow a user to place items upon central post 102, such as beach blankets, beach chairs, and the like, providing greater support and stability to wind umbrella 100. Central post 102 may be designed to connect holders for other devices, such as cups, coolers, beach bags and the like, which may provide further weight and anchoring support. In one embodiment central post 102 is a three quarter inch diameter metal shaft.

The diameter of central post 102 may be of any size contemplated by one of ordinary skill in the art without departing from the scope and spirit of the present invention.

Pivoting joint 182 is disposed at second end 106 of central post 102. Pivoting joint 182 is comprised of a snap lock joint, which connects surface spike 108 to central post 102. Pivoting joint 182 may be a variety of designs as contemplated by one of ordinary skill in the art.

Connector 160 is a metal connector disposed upon first end 104 of central post 102. Connector 160 is a hinged connector from which extends ribs 120 through 130. This hinged connection enables wind umbrella 100 to be collapsible. Connector 160 connects one end of each of the ribs 120 through 130 at equally spaced points to enable the generally quarter sphere shape of wind umbrella 100, however, the ribs may be positioned to support a structure which may take a variety of shapes. It is contemplated that connector 160 is capable of connecting a plurality of ribs and should not be read as limited to the number specified herein. Connector 160 may be composed of steel, aluminum or any other suitable metals as well as very rigid plastic, composite, wood, fiberglass and the like.

Connector 160 may be generally disposed upon first end 104, however, not at the termination point of central post 102, thus, a section of central post 102 may extend beyond connector 160. It is contemplated that in such an embodiment central post 102 may simply terminate in a closed end or may include another joint disposed upon the section extending beyond connector 160, which may connect a second surface spike. The second surface spike may be a solid metal shaft, a very rigid plastic shaft or any other suitable material capable of anchoring in a surface, or it may be of the same general description as surface spike 108 which will be described later.

Traveling connector 162 is a metal connector disposed on central post 102, generally between locking mechanism 103 and second end 106. Traveling connector 162 is capable of moving up and down central post 102 and is a hinged connector from which extends support rods 140 through 150. Traveling connector 162 connects one end of each of the support rods 140 through 150 at equally spaced points to enable the generally quarter sphere shape of wind umbrella 100, however, the support rods may be positioned to support a structure which may take a variety of shapes. It is contemplated that traveling connector 162 is capable of connecting any number of support rods and should not be read as limited to the number specified herein.

Traveling connector 162 is capable of achieving a locked position, signifying wind umbrella 100 has achieved its open position, by engaging with locking mechanism 103 and includes a release button 164 to release it from locking mechanism 103, allowing it to travel central post 102. Alternately, locking mechanism 103 may extend through traveling connector 162 in order to lock it in place, allowing a user to manually depress locking mechanism 103 to release traveling connector 162. The movement capabilities and hinged connection with support rods of traveling connector 162 farther enable wind umbrella 100 to be collapsible. The metal, of which traveling connector 162 is composed, may be steel, aluminum or any other suitable metal. Further, connector 162 may be composed of very rigid plastic, composite, wood, fiberglass or other materials, which would enable its functionality.

Metal stakes 194 and 196 may be composed of steel, aluminum or very rigid magnesium and the like. Further, they may be composed of very rigid plastic, composite, wood, fiberglass or any other suitable material, which enables their functionality. Metal stakes 194 and 196 form an "L" shape so that they can engage anchoring loops 190 and 192. Each metal spike may be shaped in any form, so long as it allows each metal spike to engage an anchoring loop, as contemplated by one of ordinary skill in the art. Additionally, each spike is of a size, which enables it to be stored in hollow 116 (shown in FIG. 2B).

Figure 2A:
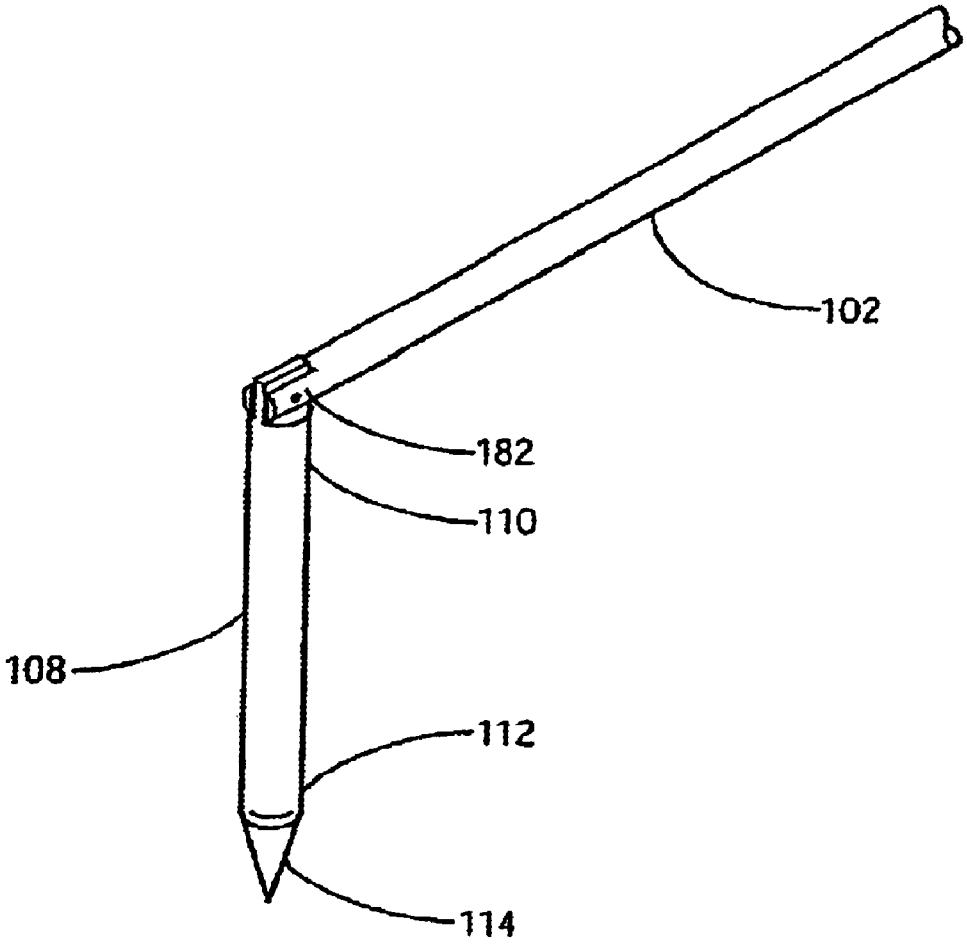
FIG. 2A is an illustration of a surface spike and a connection point to a central post of the wind umbrella in accordance with an exemplary embodiment of the present invention.
Figure 2B:
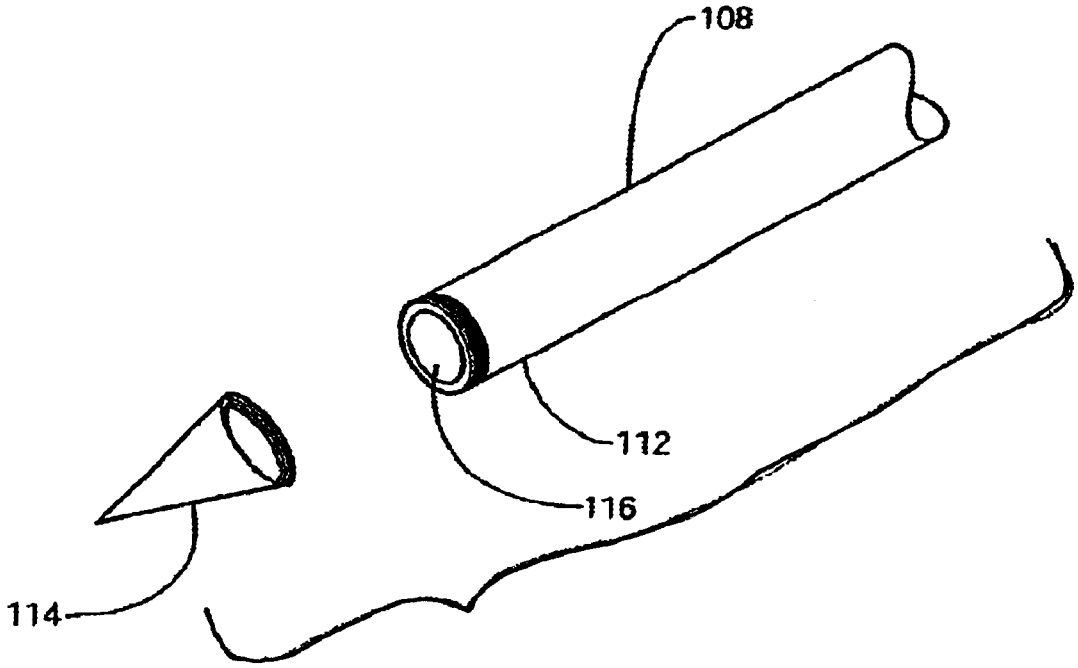
FIG. 2B is an illustration of the hollow enclosure formed by the surface spike.

Surface spike 108, shown in FIGS. 2A and 2B, is a hollow metal spike with a first end 110, a second end 112 and a cap assembly 114 enclosing hollow 116. In other embodiments the metal, of which surface spike 108 is composed, may be steel, aluminum or any other suitable metals or it may be very rigid plastic, composite, wood, fiberglass or other materials, which would enable its functionality. Surface spike 108 provides an anchor for wind umbrella 100 by implanting in the surface upon which wind umbrella 100 is placed. If the surface is not amenable to implantation, such as rock and the like, then by its connection at first end 110 with pivoting joint 182 of central post 102, surface spike 108 can be adjusted to a position which allows it to lay horizontally in linear relation to central post 102. Further, pivoting joint 182 allows surface spike 108 to be adjustable to a variety of positions in order to accommodate changed surface conditions. Surface spike 108 may be constructed with materials, which give it substantial weight. Thus, enabling surface spike 108, when unable to implant in the surface, as a weighted anchor for wind umbrella 100.

Second end 112 is circumferentially threaded to connect cap assembly 114. In one embodiment cap assembly 114 is composed of the same metal as surface spike 108 and forms a pointed end of surface spike 108. In other embodiments, the metal of which cap assembly 114 is composed may be steel, aluminum or any other suitable metal or it may be very rigid plastic, composite, wood, fiberglass or other materials, which enable its functionality. Second end 112 may include a variety of connecting mechanisms to secure cap assembly 114 to it as may be contemplated by one of ordinary skill in the art. Cap assembly 114 may also; include a variety of connecting mechanisms so long as it matches the connecting mechanisms included on second end 112 to enable a coupling with second end 112. Further, cap assembly 114 may be shaped in any way to enable implantation of surface spike 108 in any surface. It is contemplated that wind umbrella 100 may have any number of cap assembly 114 attachments suitable for coupling with second end 112 of surface spike 108.

Hollow 116, of surface spike 108, is capable of storing metal stakes 194 and 196 within. Thus, surface spike 108 is of sufficient length to include within hollow 116 such metal stakes. Hollow 116 may be capable of holding any number of metal stakes and should not be read as limited to only holding metal stakes 194 and 196.

The spine assembly, shown in FIGS. 1A, 1B, 3 and 4, forms a generally quarter sphere shaped support apparatus for covering 154. The shape of wind umbrella 100 may take a variety of forms as may be contemplated by one or ordinary skill in the art without departing from the scope and spirit of the present invention. In one embodiment the spine assembly is made up of the six ribs 120 through 130, the six support rods 140 through 150 and the first edge 134. First edge 134 is the combination of ribs 120 and 130. Ribs 120 and 130 are spaced one hundred eighty degrees from each other and form a flat edge, which is situated on the surface upon which wind umbrella 100 is located. Alternately, ribs 120 and 130 may be situated either greater than or lesser than one hundred eighty degrees relative to each other, still providing first edge 134 to whatever shape wind umbrella 100 may take.

Anchoring loop 190 is connected to rib 120 at the end of the rib opposite its connection to connector 160 and anchoring loop 192 is connected to rib 130 at the end of the rib opposite its connection to connector 160. Anchoring loops 190 and 192 may be engaged by securing means 194 and 196 to hold first edge 134 in a secure horizontal position on the surface. Metal stakes 194 and 196 may take a variety of forms, anchoring loops 190 and 192 may also take a variety of forms as may be contemplated by one of ordinary skill in the art, so long as their forms enable engagement with one another.

When wind umbrella 100 is in the open position the ribs and support rods extend covering 154 in a quarter sphere shaped form, which is generally perpendicular to the surface. As mentioned previously, the number of ribs and support rods may vary yet still enable the quarter sphere shape and collapsibility of wind umbrella 100. Each rib is connected to covering 154 at one end, that being the end that is not connected to connector 160. This connection may occur through a pocket designed in the covering within which the rib may be inserted, an adhesion process or any other suitable means, which accomplishes the coupling of covering 154 to the end of the rib.

Hinged joints 170 through 180 are located between the connected ends of each rib. Hinged joint 170 connects an end of each support rod 140 through 150 to each corresponding rib 120 through 130. The hinged functionality further enables the collapsibility of wind umbrella 100. Hinged joint 170 is a metal hinge and may be composed of steel, aluminum, very rigid magnesium and the like. Further, hinged joint 170 may be composed of a very rigid plastic, composite, wood, fiberglass or any other suitable material, which enables its functionality.

Figure 1B:
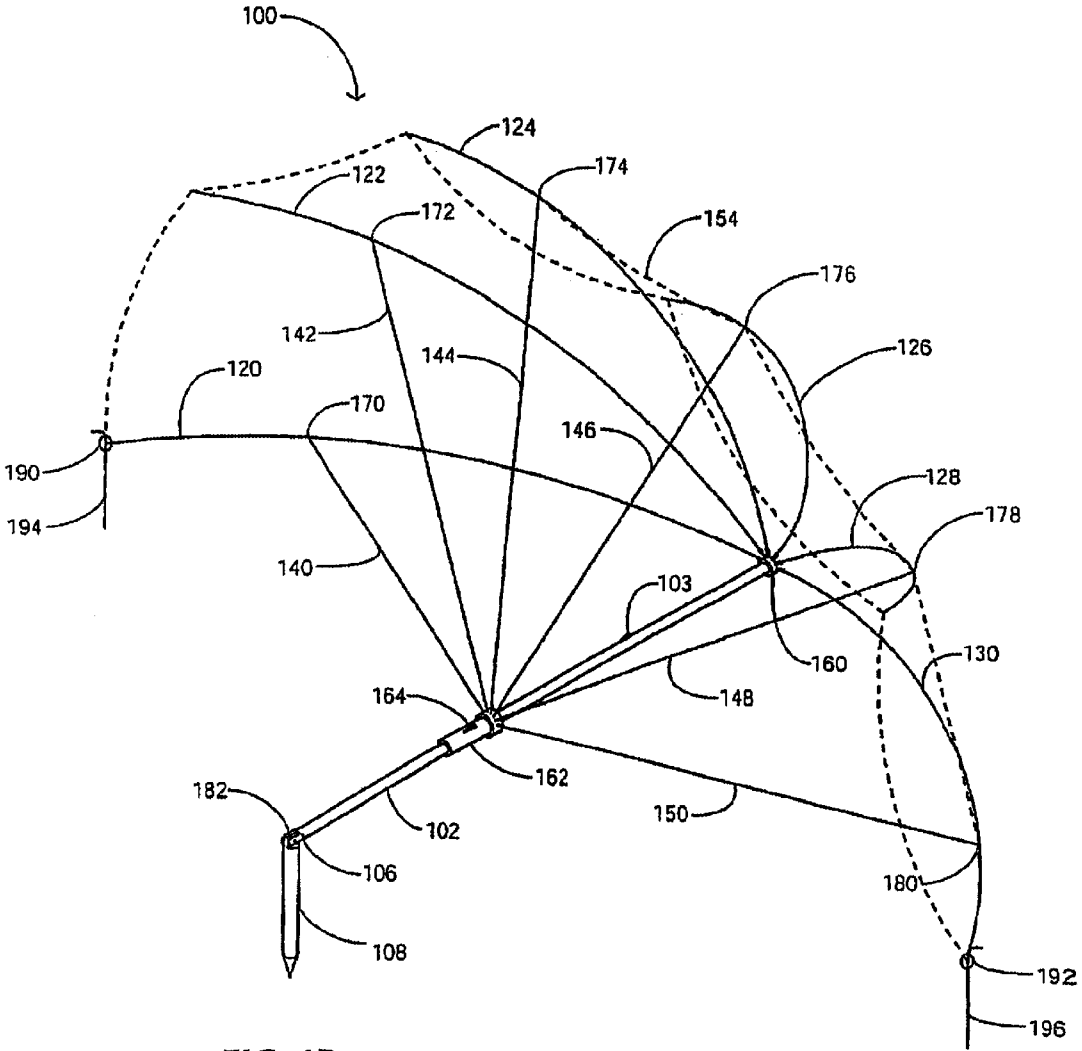
FIG. 1B is an isometric view illustrating the wind umbrella in a partially collapsed position, with a traveling connector released from a locking mechanism, in accordance with exemplary embodiment of the present invention.
Figure 3:
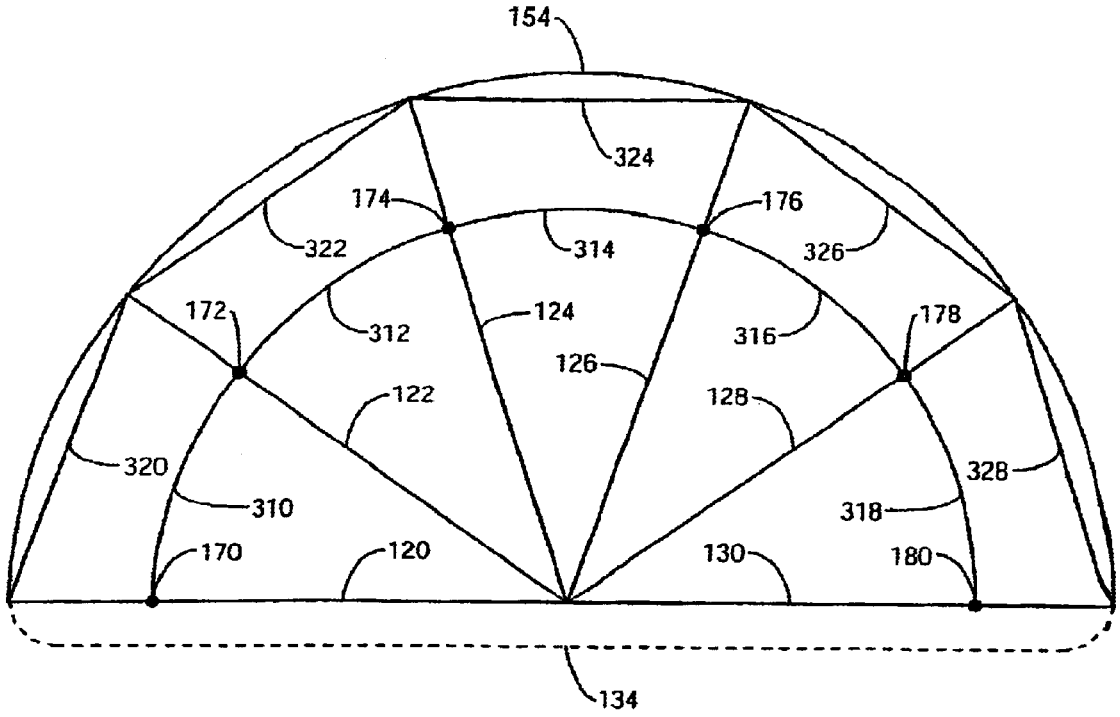
FIG. 3 is an elevation view illustrating the wind umbrella in accordance with an embodiment of the present invention.
Figure 4:
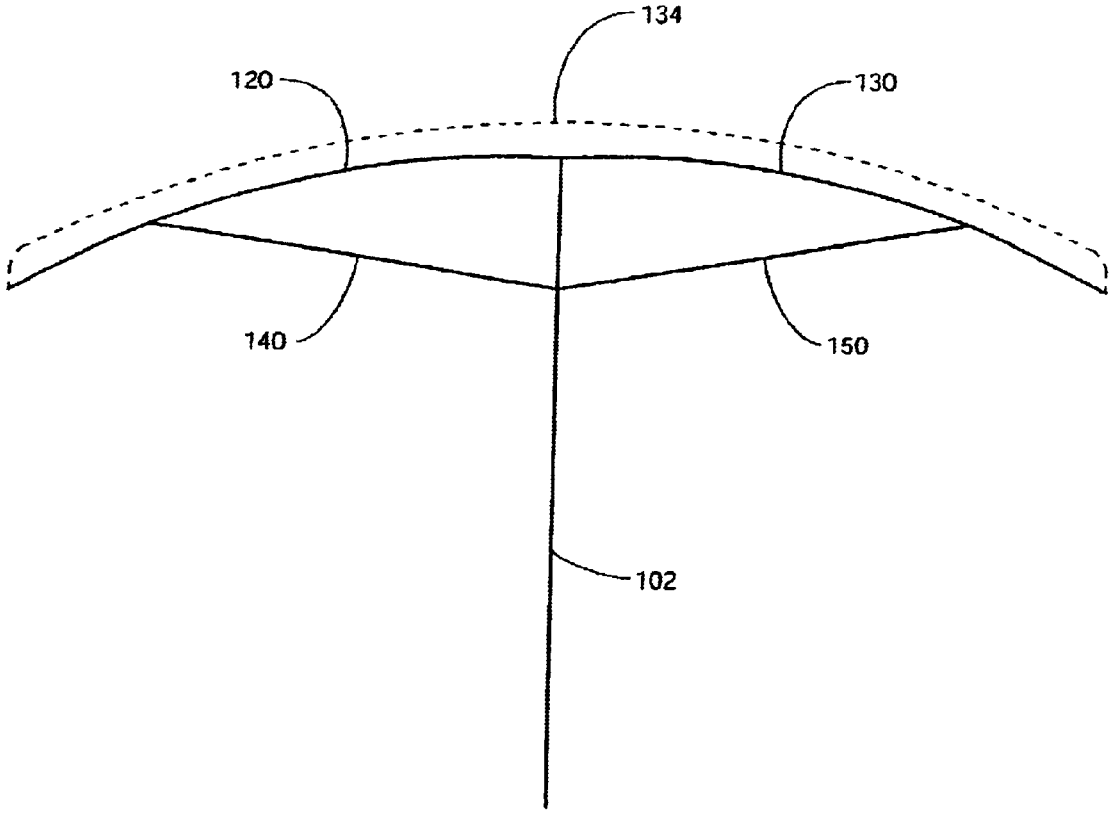
FIG. 4 is a plan view illustrating the wind umbrella in accordance with an exemplary embodiment of the present invention.

Covering 154, shown in FIGS. 1A, 1B and 3, spans the entire spine assembly. As discussed when wind umbrella is in the open position the covering extends to form a generally quarter sphere shape. It is enabled to accomplish this through the connection point covering 154 has with each rib 120 through 130 of the spine assembly. It is contemplated that covering 154 may be attached to each rib at multiple points. Further, covering 154 is coupled with connector 160, however, in other embodiments covering 154 may not be connected with connector 160.

Covering 154 is composed of a transparent elastic, sheet plastic material. It is contemplated that covering 154 may be composed of any type of material, transparent or non-transparent, which is capable of enabling the function of wind umbrella 100, such as cloth, vinyl, canvas and the like. Further, covering 154 may be of a rigid material with separate hinged joints between various panels of the rigid material to enable it to provide the same collapsible functionality, such as fiberglass, composites and the like.

FIG. 3 shows covering 154 may contain a first set of lateral support structures 310, 312, 314, 316 and 318. This first set may be enabled through a variety of methods and processes, such as double stitching, by developing lateral pockets, within which rigid pieces of material may be inserted, or any other suitable methods and processes which would enable a user to provide wind umbrella 100 with greater structural support and stability. A second set of lateral support structures 320, 322, 324, 326 and 328 may be included within covering 154. This second set may be enabled through the same methods and processes as mentioned above, providing the same functionality.

It is contemplated that the first and second set of lateral support structures may be integrated within the spine assembly or attached by hinged joints, pivoting joints and the like, to the spine assembly. These lateral support structures may be composed of metal, plastic or any other suitably rigid material capable of providing structural support and stability.

It is believed that the wind umbrella of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A wind umbrella apparatus, comprising:

a central post with a first end, a second end coupled with a pivoting joint, and a locking mechanism, the pivoting joint coupled with a first end of a surface spike;

a spine assembly, of a generally quarter sphere shape and including a plurality of ribs connected to the central post and a plurality of support rods connected to the plurality of ribs and the central post; and a covering connected in one or more places to the plurality of ribs and spanning the plurality of ribs, wherein the wind umbrella apparatus, in an open position, is situated horizontally on a surface with a first edge, connecting anchoring loops at both ends, of the spine assembly and the central post lying flat on the surface and the covering extending generally perpendicularly from the surface to provide protection from the wind and sun.

2. The wind umbrella apparatus of claim 1, wherein the surface spike further comprises a hollow enclosure, the hollow enclosure for housing a securing means, and a second end connecting a cap assembly.

3. The wind umbrella apparatus of claim 2, therein the securing means housed within the surface spike include "L" shaped metal stakes which, may be removed from the surface spike and engage with the anchoring loops connected at both ends of the first edge and implant in the surface when the wind umbrella is in the open position.

4. The wind umbrella apparatus of claim 1, wherein the first end of the central post comprises a connector, which connects a first end of the plurality of ribs in a one hundred eighty degree arc around the central post.

5. The wind umbrella apparatus of claim 1, wherein a traveling connector is disposed between the second end and the locking mechanism of the central post, capable of achieving a locked position and including a release button, the traveling connector connects a first end of the plurality of support rods in a one hundred eighty degree arc around the central post.

6. The wind umbrella apparatus of claim 1, wherein the plurality of ribs further comprise a second end connecting the covering.

7. The wind umbrella apparatus of claim 1, wherein the plurality of support rods further comprise a second end connected to a hinged joint disposed upon each of the plurality of ribs on a location between the first end and the second end of the plurality of ribs.

8. The wind umbrella apparatus of claim 1, wherein the spine assembly is a collapsible spine assembly to enable the open position and a closed position, for easy user transport, of the wind umbrella apparatus.

9. The wind umbrella apparatus of claim 1, wherein the covering is at least one of a transparent material and a nontransparent material.

10. The wind umbrella apparatus of claim 1, wherein the spine assembly includes at least six ribs and at least six support rods.

11. The wind umbrella apparatus of claim 1, wherein the pivoting joint is a snap lock joint.

12. A wind umbrella apparatus, comprising:

a central post with a first end, a second end and a locking mechanism;

a surface spike including a first end, a second end and a hollow enclosure, the hollow enclosure for housing a securing means, the first end of the surface spike connected to the second end of the central post by a pivoting joint and the second end of the surface spike connecting a cap assembly;

a spine assembly, of a generally quarter sphere shape, including a plurality of ribs with a first end and a second end, the first end of the plurality of ribs connected to a connector disposed upon the first end of the central post and a plurality of support rods with a first end and a second end, the first end of the plurality of support rods connected to a traveling connector disposed upon the central post and the second end of the plurality of support rods connected to the plurality of ribs between the first end and the second end of the plurality of ribs; and a covering connected in one or more places to the plurality of ribs, including the second end of the plurality of ribs, and spanning the plurality of ribs, wherein the wind umbrella apparatus, in an open position, is situated horizontally on a surface with a first edge, connecting anchoring loops at both ends, of the spine assembly and the central post lying flat on the surface and the covering extending generally perpendicularly from the surface to provide protection from the wind and sun.

13. The wind umbrella apparatus of claim 12, wherein the first end of the central post disposed with the connector, connects a first end of the plurality of ribs in a one hundred eighty degree arc around the central post.

14. The wind umbrella apparatus of claim 12, wherein the traveling connector is disposed between the first end and the second end of the central post, capable of achieving a locked position and including a release button, the traveling connector connects a first end of the plurality of support rods in a one hundred eighty degree arc around the central post.

15. The wind umbrella apparatus of claim 12, wherein the securing means housed within the surface spike include "L" shaped metal stakes which, may be removed from the surface spike and engage with the anchoring loops connected at both ends of the first edge and implant in the surface when the wind umbrella is in the open position.

16. The wind umbrella apparatus of claim 12, wherein the spine assembly is a collapsible spine assembly to enable the open position and a closed position.

17. The wind umbrella apparatus of claim 12, wherein the covering is at least one of a transparent material and a nontransparent material.

18. The wind umbrella apparatus of claim 12, wherein the spine assembly includes at least six ribs and at least six support rods.

19. A wind umbrella apparatus, comprising:

a central post with a first end, a second end and a locking mechanism, the first end being disposed with a connector, the second end being disposed with a pivoting joint and a traveling connector that includes a release button, disposed between the second end and the locking mechanism, capable of achieving a locked position to enable an open position;

a surface spike including a first end, a second end and a hollow enclosure, the hollow enclosure for housing removable "L" shaped metal stakes, the first end of the surface spike connected to the second end of the central post by the pivoting joint and the second end of the surface spike connecting a cap assembly;

a collapsible spine assembly, of a generally quarter sphere shape, enabling the open position and a closed position, including a plurality of ribs with a first end and a second end, the first end of the plurality of ribs connected in a one hundred eighty degree arc to the connector disposed upon the first end of the central post and a plurality of support rods with a first end and a second end, the first end of the plurality of support rods connected, in a one hundred eighty degree arc, to the traveling connector disposed upon the central post and the second end of the plurality of support rods connected to a hinged joint disposed upon each of the plurality of ribs between their first end and second end; and a covering including at lest one of a transparent material and a nontransparent material, connected in one or more places to the plurality of ribs, including the second end of the plurality of ribs, and spanning the plurality of ribs, wherein the wind umbrella apparatus, in an open position, is situated horizontally on a surface with a first edge, connecting anchoring loops at both ends engaged with the removable "L" shaped metal stakes that implant in the surface, of the spine assembly and the central post lying flat on the surface and the covering extending generally perpendicularly from the surface to provide protection from the wind and sun.

20. The wind umbrella apparatus of claim 19, wherein the spine assembly further includes at least six ribs and at least six support rods.

* * * * *